US008123587B2

(12) United States Patent
Liegey

(10) Patent No.: US 8,123,587 B2
(45) Date of Patent: Feb. 28, 2012

(54) CONVERTIBLE BRA

(76) Inventor: Catharine M. Liegey, New York, NY (US)

( * ) Notice: Subject to any disclaimer, the term of this patent is extended or adjusted under 35 U.S.C. 154(b) by 0 days.

(21) Appl. No.: 12/731,132

(22) Filed: Mar. 24, 2010

(65) Prior Publication Data

US 2010/0297913 A1 Nov. 25, 2010

Related U.S. Application Data

(60) Provisional application No. 61/162,955, filed on Mar. 24, 2009.

(51) Int. Cl.
*A41C 3/00* (2006.01)

(52) U.S. Cl. ..... 450/36; 450/1

(58) Field of Classification Search ..... 450/2–61, 450/70, 86–91; 2/73, 109, 110, 267; 24/585.11, 24/588.1, DIG. 39, 50, 42
See application file for complete search history.

(56) References Cited

U.S. PATENT DOCUMENTS 2,654,091 A * 10/1953 Nelson ..... 450/14
2,671,218 A * 3/1954 Luhr ..... 450/22
2,748,771 A * 6/1956 Richards ..... 604/346
3,149,635 A * 9/1964 Garutso ..... 450/36
3,206,424 A * 9/1965 Heinrich et al. ..... 525/263
3,425,420 A * 2/1969 Steinberger ..... 450/36
3,925,856 A * 12/1975 Plummer, III ..... 24/586.1
4,268,938 A * 5/1981 Walchli ..... 53/334
5,269,720 A * 12/1993 Moretz et al. ..... 450/37
5,938,500 A * 8/1999 Hampton ..... 450/32
6,319,092 B1 * 11/2001 Leyhe et al. ..... 450/36

* cited by examiner

*Primary Examiner* — Gloria Hale

(57) ABSTRACT

An intimate apparel apparatus includes a brassiere frame with a chest band for securing the brassiere frame to the wearer, and a first arcuate recess in the brassiere frame for receiving a first detachable brassiere cup. A first arcuate channel is located along the edge of first arcuate recess. A first detachable brassiere cup has a first arcuate latch at a perimeter thereof. The first arcuate latch and the first arcuate channel are slidably engageable with one another, and have substantially identical cross sections, such that the substantially identical cross sections resist transverse separation from each other when slidably engaged. An intimate apparel set includes at least one brassiere garment as described above, and additionally further pair or pairs of detachable brassiere cups, interchangeable with those already described.

20 Claims, 14 Drawing Sheets

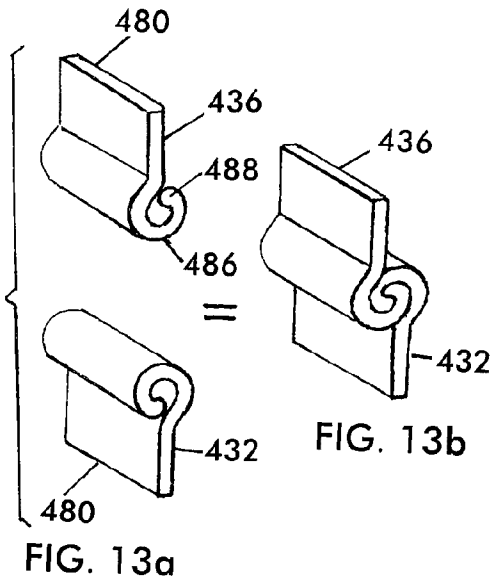
FIG. 13a
FIG. 13b
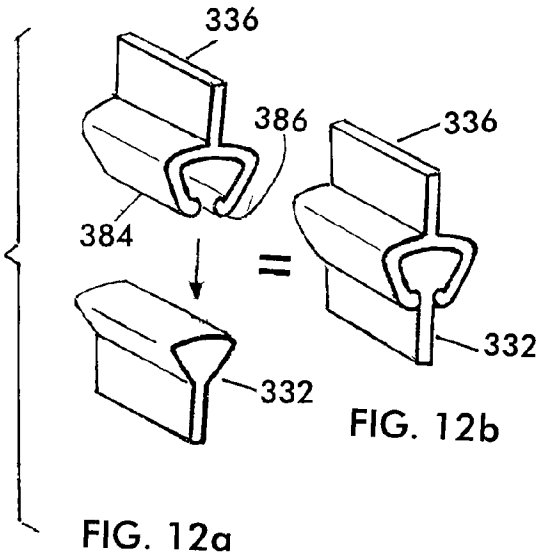
FIG. 12a
FIG. 12b
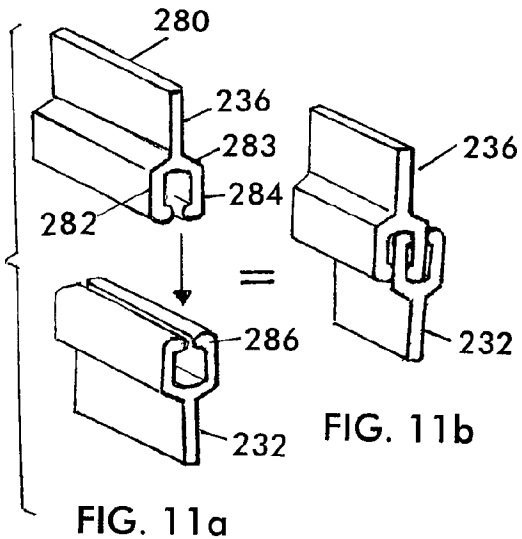
FIG. 11a
FIG. 11b

CONVERTIBLE BRA

CROSS-REFERENCE TO RELATED APPLICATIONS

This application claims priority to U.S. Provisional Patent Application Ser. No. 61/162,955, entitled CONVERTIBLE BRA, filed 24 Mar. 2009, the complete disclosure of which is hereby incorporated by its reference for all purposes.

BACKGROUND

1. Field of the Invention

The present invention relates to the field of intimate apparel, and more particularly to a brassiere having easily detachable and interchangeable cups.

2. Description of the Related Art

Brassieres themselves are a very mature art, dating to the early $19^{th}$ century in the US alone. However, there remains a need in the art for a brassiere having removable cups and a set including a brassiere frame to which one of several removable cups may be attached, to select among various fashion selections, and/or chose from among plural size and shapes of cup for the various effects these provide to the wearer.

BRIEF SUMMARY

It is an object of the present disclosure to provide a brassiere garment having interchangeable cup portions. Cups may be interchanged in order to provide alternate shaping options that a variety of cups can provide, or alternate fashion options, without the need to produce and purchase an entire different and new brassiere structure.

Therefore, according to the present disclosure, an intimate apparel apparatus includes a brassiere frame with a chest band for securing the brassiere frame to the wearer, and a first arcuate recess in the brassiere frame for receiving a first detachable brassiere cup. A first arcuate channel is located along the edge of first arcuate recess. A first detachable brassiere cup has a first arcuate latch at a perimeter thereof. The first arcuate latch and the first arcuate channel are slidably engageable with one another, and have substantially identical cross sections, such that the first arcuate latch and the first arcuate channel resist transverse separation from each other when slidably engaged. The arcuate latch and the arcuate channel are optionally concealed or concealable, in a front view, by material of the brassiere frame or the first detachable brassiere cup.

The cross section of the first arcuate latch and the first arcuate channel may include a spiral portion, optionally having a lip relatively greater thickness at its end. The cross section may alternately include a pair of substantially parallel walls, optionally having a closed end to which the substantially parallel walls are each attached. A lip section of relatively greater thickness may be provided at an end of at least one of the substantially parallel walls. Where a closed end and a lip are provided, the lip section may extend into an area bounded by the closed end and the substantially parallel walls. The distance between the nearest points of the substantially parallel walls, including any lip, may be set to no greater than about the largest thickness of either of the substantially the parallel walls, including any lip.

The engageable ends of the first arcuate latch and/or the first arcuate channel may be provided with a surface treatment to enhance their visibility, for example contrasting color, thereby facilitating their sliding engagement. A similar color may be applied to both engageable ends. The color applied to the engageable ends of the first and second detachable cups and corresponding channels may be distinguished from each other, but similar between the matched latch and channel.

Further provided according to the instant disclosure is an intimate apparel set, including at least one brassiere garment as described above, and additionally having further pair or pairs of detachable brassiere cups, interchangeable with those already described. The plurality of detachable brassiere cup pairs may each comprise a distinguished style, size, shape, color material, or pattern from the other detachable brassiere cup pairs in the set.

BRIEF DESCRIPTION OF THE DRAWING(S)

These and other features, benefits and advantages of the present disclosure will become apparent from the following description of the invention which refers to the accompanying drawings, where like reference numerals refer to like structures across the several views, and wherein.

Figure 6:
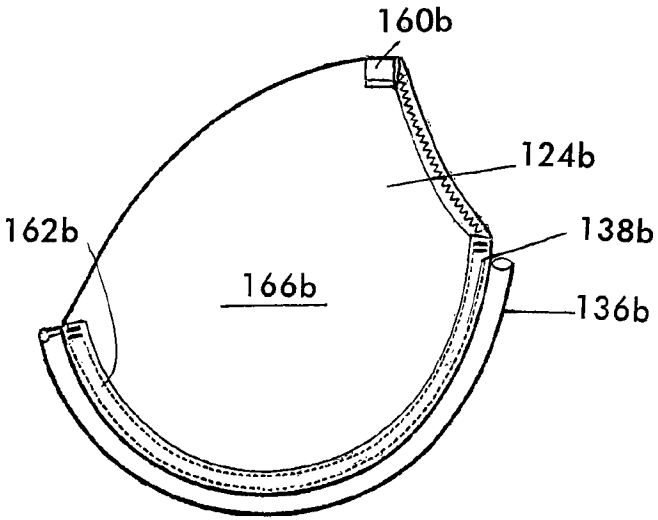
Figure 9A:
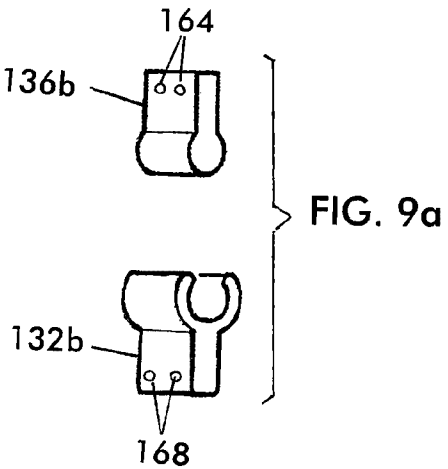
Figure 9B:
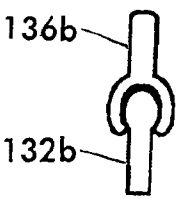
Figure 7:
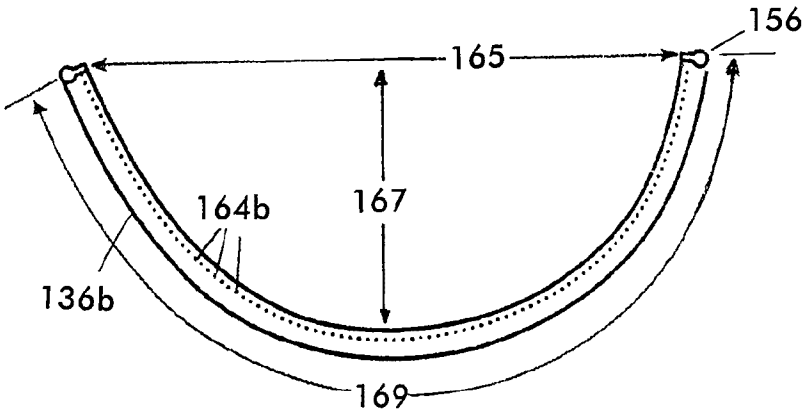
Figure 8:
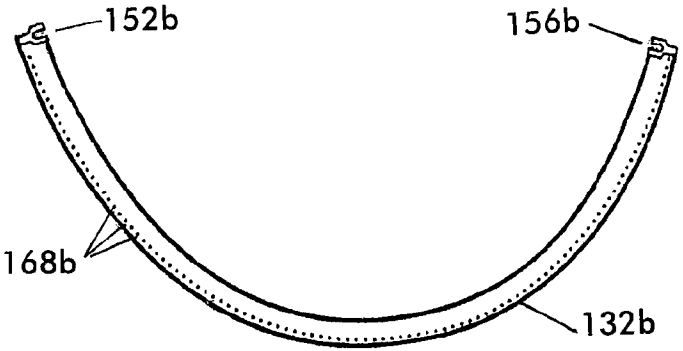
Figure 10:
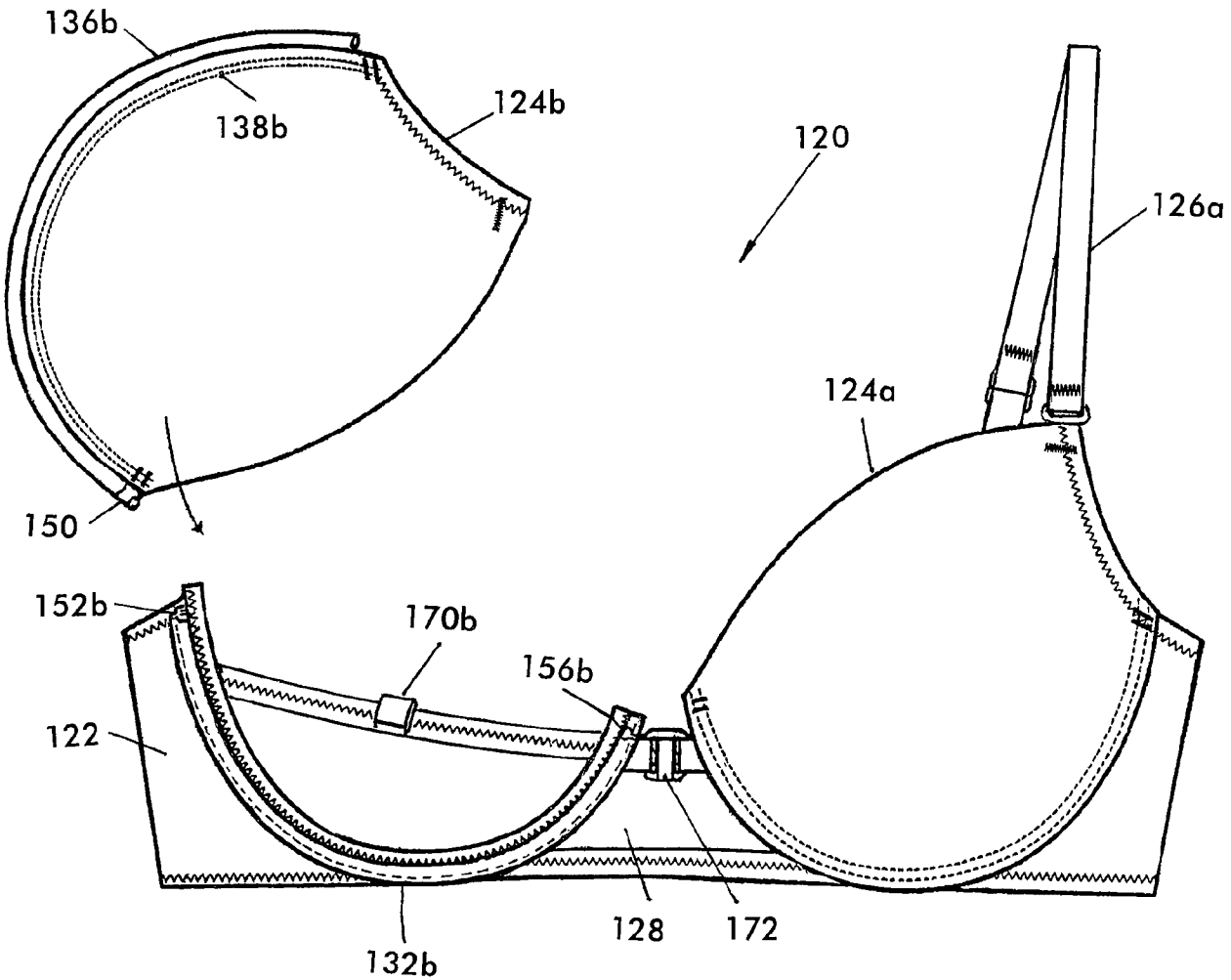
Figure 14:
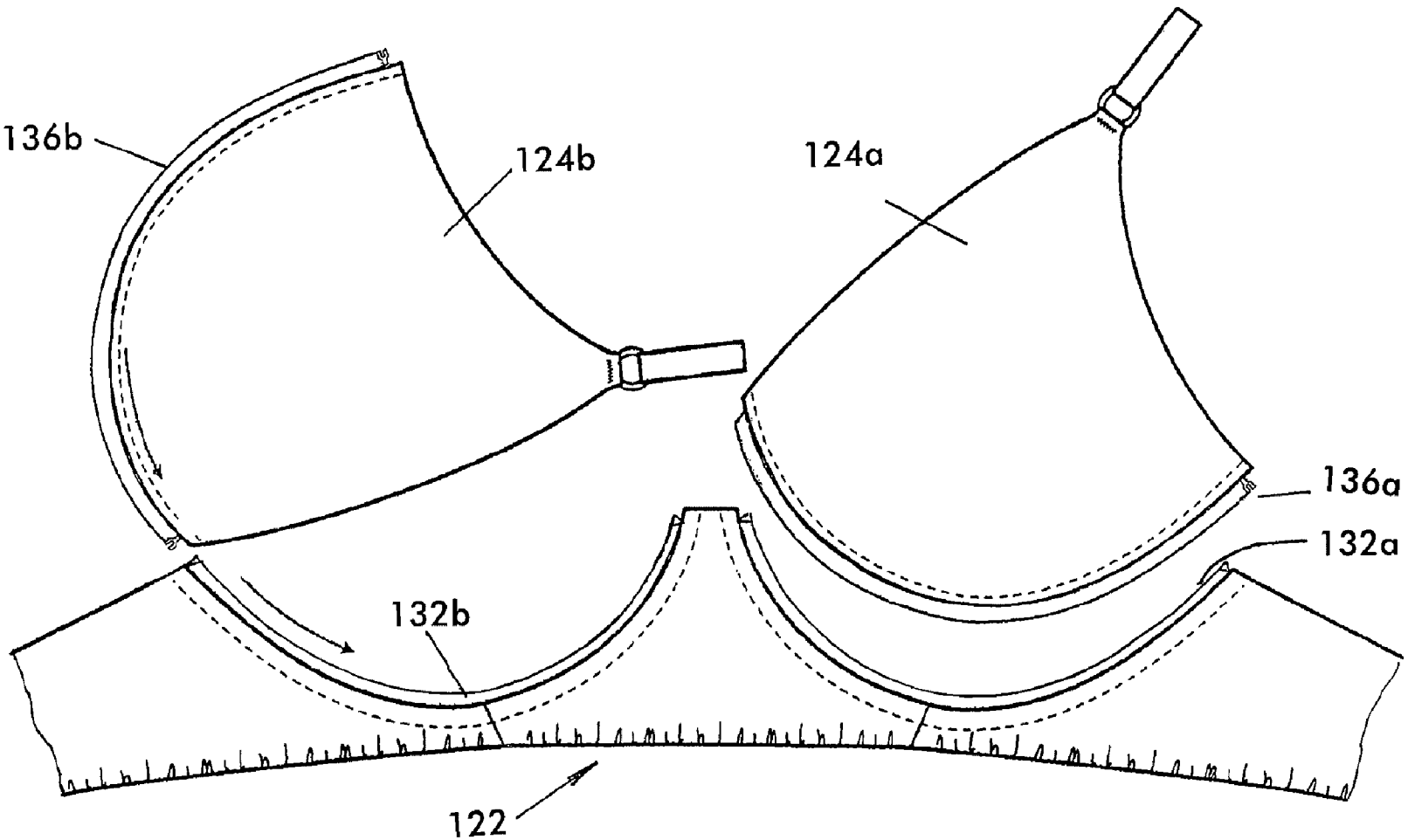
Figure 15C:
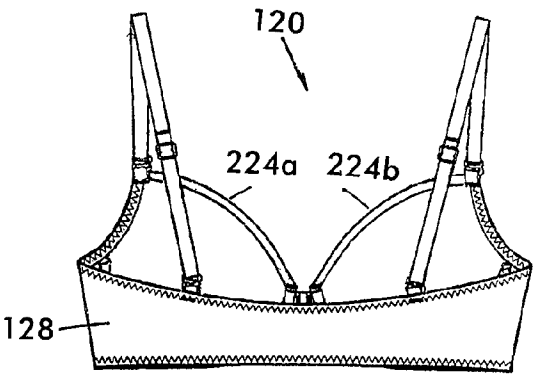
Figure 15B:
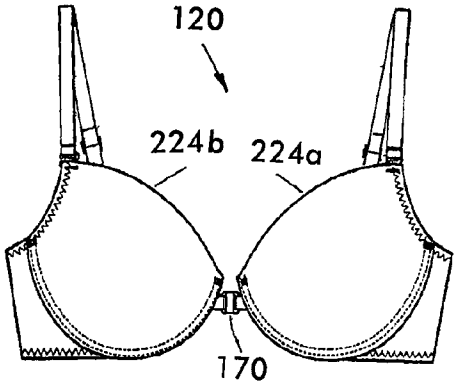
Figure 15A:
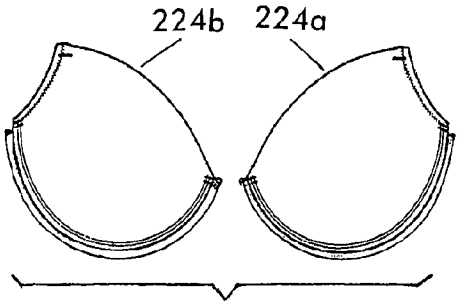
Figure 16C:
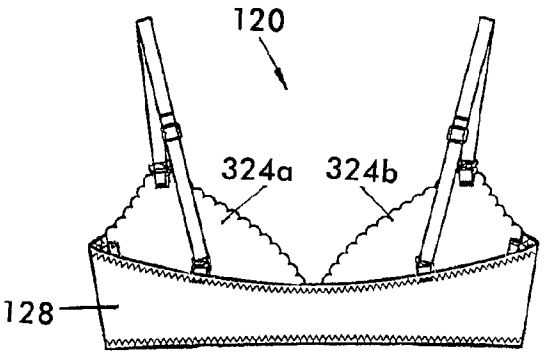
Figure 16B:
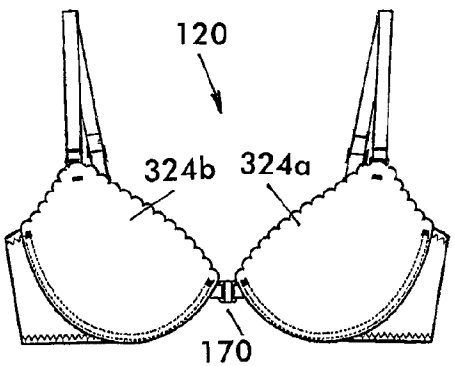
Figure 16A:
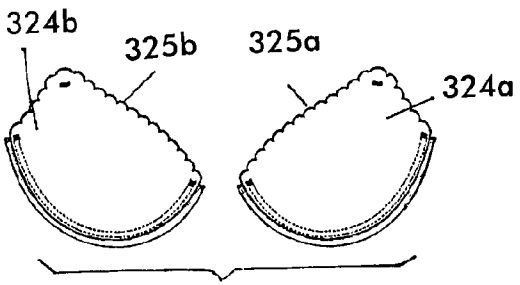
Figure 17C:
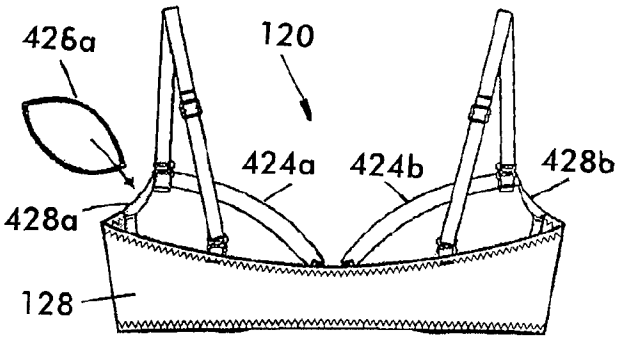
Figure 17B:
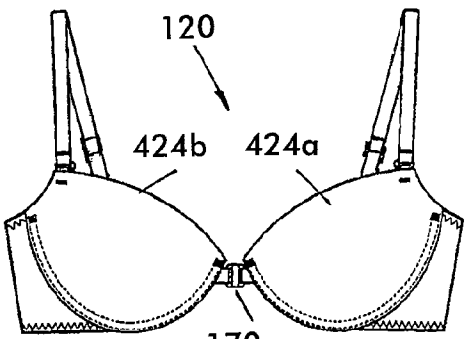
Figure 17A:
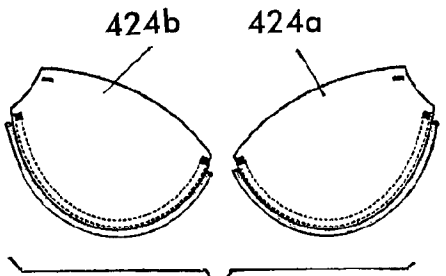
Figure 18C:
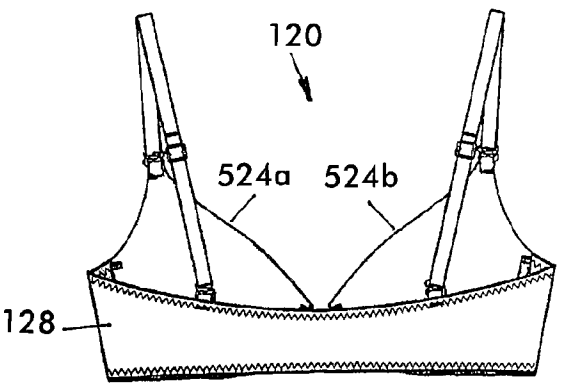
Figure 18B:
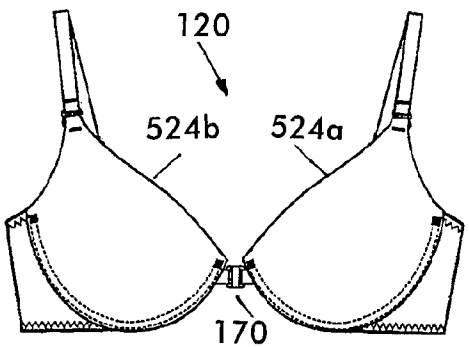
Figure 18A:
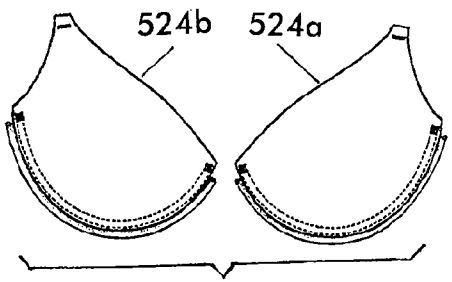
Figure 19C:
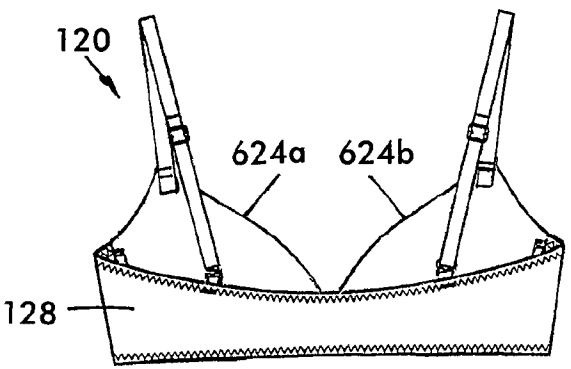
Figure 19B:
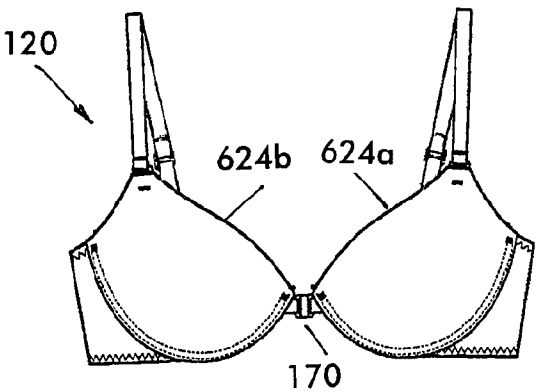
Figure 19A:
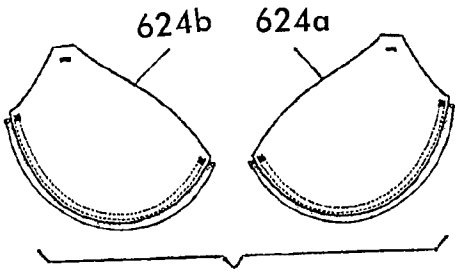
Figure 20:
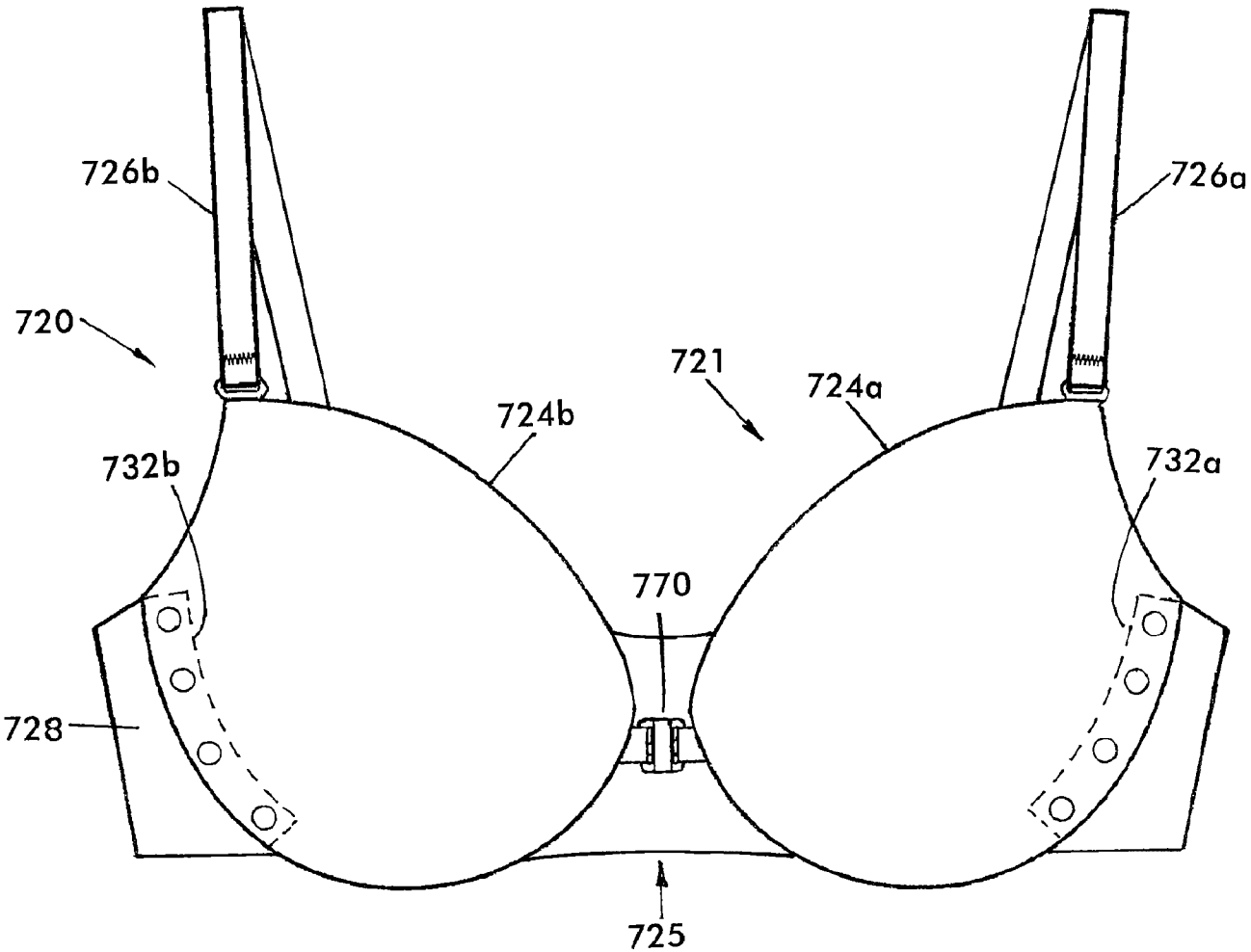
Figure 21:
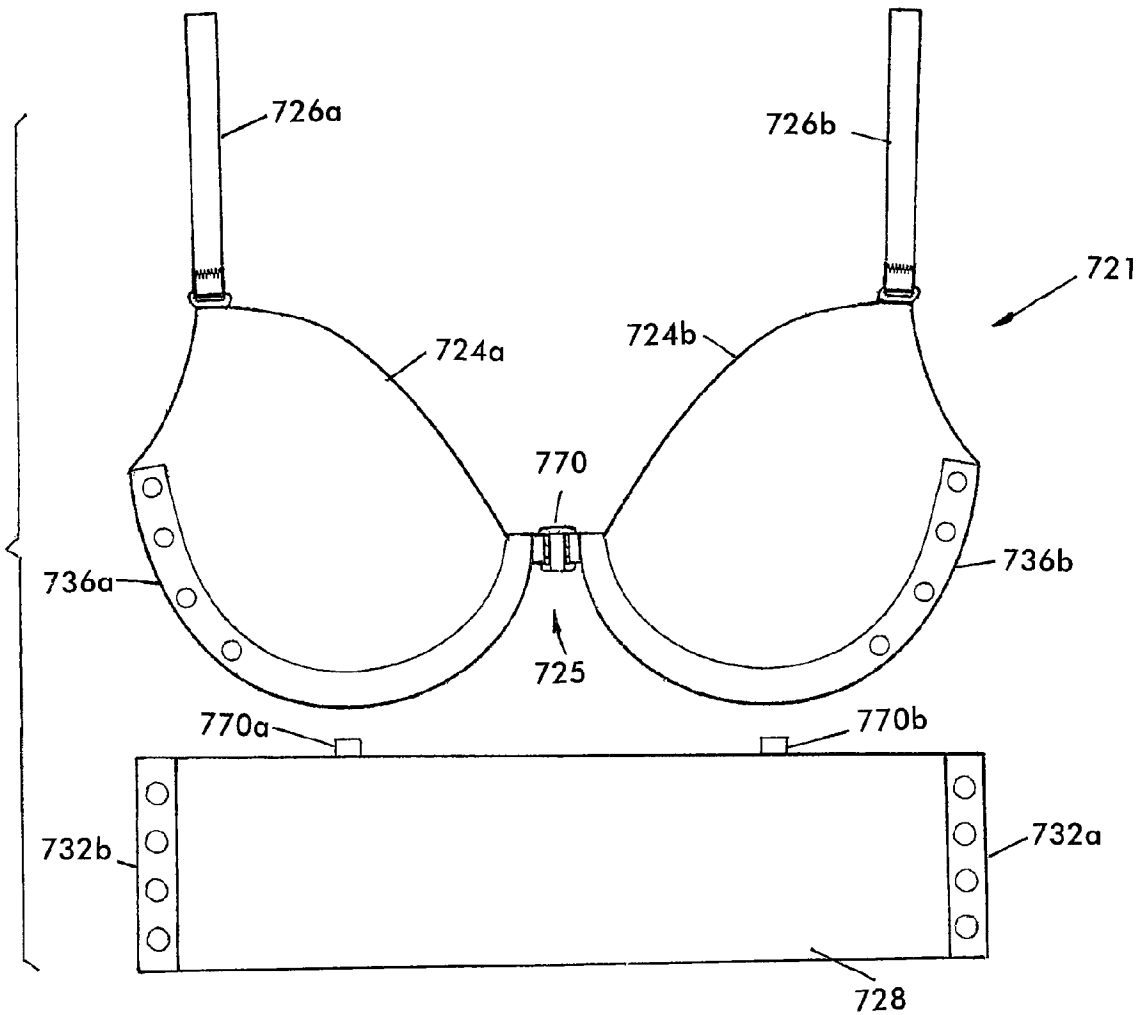
Figure 22:
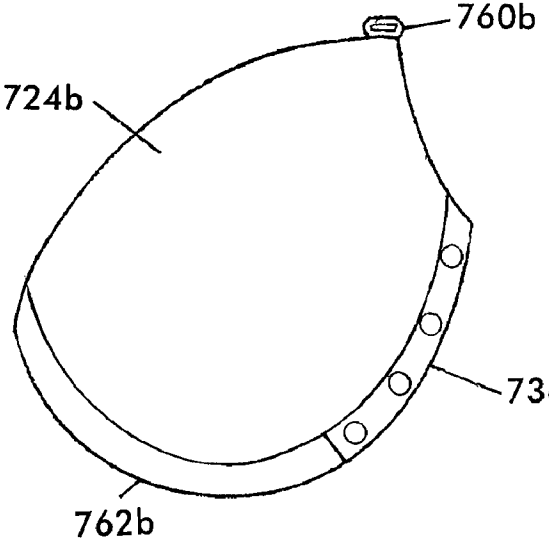
Figure 23:
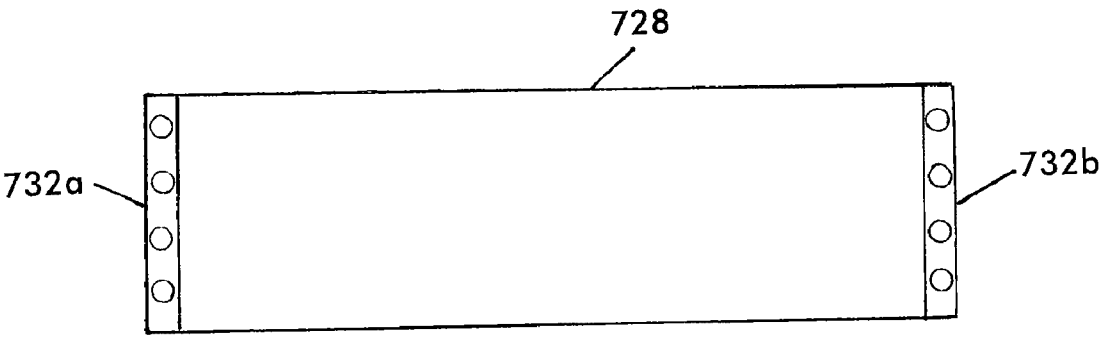
Figure 24:
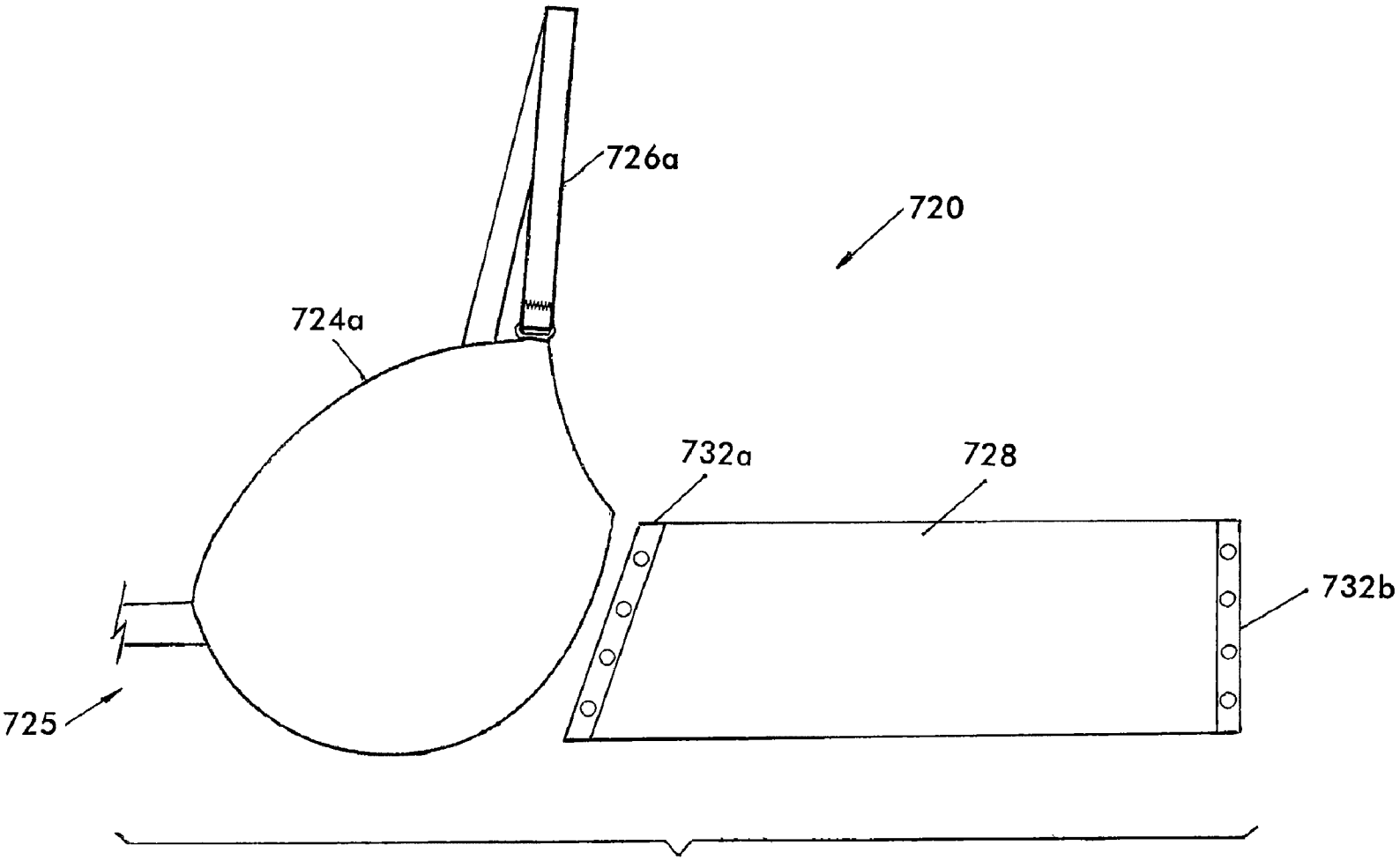

FIGS. 5*a*, 5*b*, 5*c* and 5*d* illustrate a progression of engaging a detachable brassiere cup with the brassiere frame according to the first embodiment of the present disclosure;

FIG. 6, illustrates a rear view of a detachable brassiere cup according to the first embodiment of the present disclosure;

FIG. 7 illustrates a latch according to the first embodiment of the present disclosure;

FIG. 8 illustrates a channel according to the first embodiment of the present disclosure;

FIGS. 9*a* and 9*b* illustrate the engagement of a latch and channel with one another according to the first embodiment of the present disclosure, illustrating unattached and attached states, respectively;

FIG. 10 illustrates a front elevation view the brassiere according to a second embodiment of the present disclosure, having one detachable brassiere cup removed;

FIGS. 11*a* and 11*b* illustrate a first alternate configurations for the latch and channel, in unattached and attached states, respectively;

FIGS. 12*a* and 12*b* illustrate a second alternate configuration for the latch and channel, in unattached and attached states, respectively;

FIGS. 13*a* and 13*b* illustrate a third alternate configuration for the latch and channel, in unattached and attached states, respectively;

FIG. 14 illustrates a partial front elevation view of a further embodiment of a brassiere according to the present disclosure;

FIG. 15*a* illustrates a front elevation view of a pair of detachable brassiere cups in a first style;

FIG. 15*b* illustrates a front elevation view of the first style of detachable brassiere cups installed in a brassiere frame;

FIG. 15*c* illustrates a rear elevation view of the first style of detachable brassiere cups installed in a brassiere frame;

FIG. 16*a* illustrates a front elevation view of a pair of detachable brassiere cups in a second style;

FIG. 16*b* illustrates a front elevation view of the second style of detachable brassiere cups installed in a brassiere frame;

FIG. 16*c* illustrates a rear elevation view of the second style of detachable brassiere cups installed in a brassiere frame;

FIG. 17*a* illustrates a front elevation view of a pair of detachable brassiere cups in a third style;

FIG. 17*b* illustrates a front elevation view of the third style of detachable brassiere cups installed in a brassiere frame;

FIG. 17*c* illustrates a rear elevation view of the third style of detachable brassiere cups installed in a brassiere frame;

FIG. 18*a* illustrates a front elevation view of a pair of detachable brassiere cups in a fourth style;

FIG. 18*b* illustrates a front elevation view of the fourth style of detachable brassiere cups installed in a brassiere frame;

FIG. 18*c* illustrates a rear elevation view of the fourth style of detachable brassiere cups installed in a brassiere frame;

FIG. 19*a* illustrates a front elevation view of a pair of detachable brassiere cups in a fifth style;

FIG. 19*b* illustrates a front elevation view of the fifth style of detachable brassiere cups installed in a brassiere frame;

FIG. 19*c* illustrates a rear elevation view of the fifth style of detachable brassiere cups installed in a brassiere frame;

FIG. 20 illustrates brassiere according to a third embodiment of the present disclosure;

FIG. 21 illustrates a rear exploded assembly view of the third embodiment;

FIG. 22 shows a detachable brassiere cup according to the third embodiment;

FIG. 23 shows a detachable side and back panel of a brassiere according to the third embodiment; and FIG. 24 shows a partial exploded assembly view of the brassiere cup and side and back panel of the third embodiment.

DETAILED DESCRIPTION OF THE EMBODIMENTS

Figure 1:
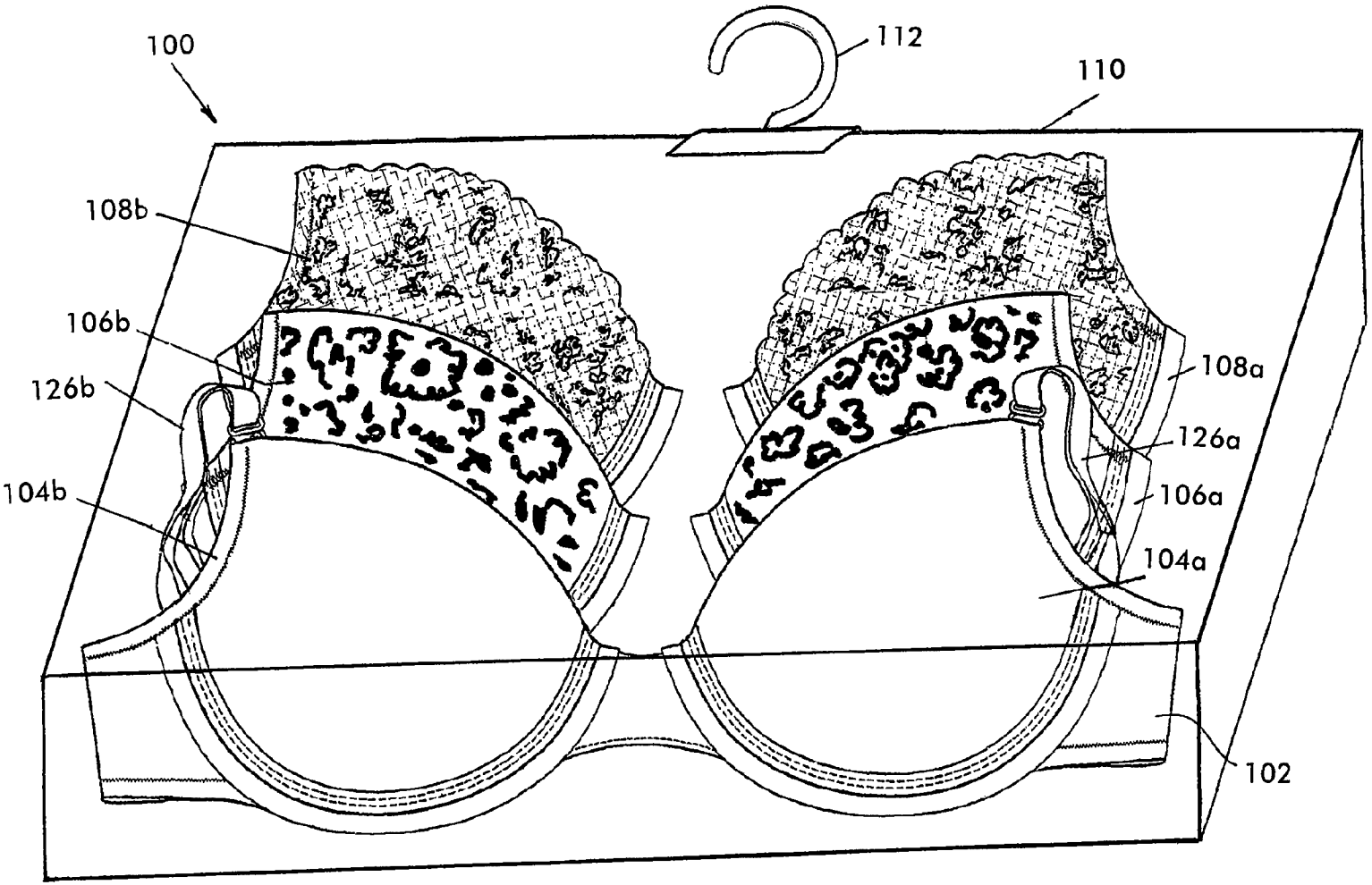
FIG. 1 illustrates a boxed brassiere set according to a first embodiment of the present disclosure.

Referring now to FIG. 1, illustrated is a boxed brassiere set, generally 100, including a bra frame 102 matched sets of detachable brassiere cups 104*a* and 104*b*, 106*a* and 106*b*, 108*a* and 108*b*. In this instance, the set is packaged in a box 110, optionally transparent, as in this case, and further optionally including a hanger hook 112 for display and sale. Hanger hook 112 may be selectively removable. As will be explained in more detail herein, any of brassiere cups 104*a* and 104*b*, 106*a* and 106*b*, 108*a* and 108*b* are selectively attachable to or detachable from bra frame 102. Alternately, the brassiere according to the present disclosure may be sold as a complete individual unit, i.e. having a bra frame 102, a single pair of cups 104*a* and 104*b*, 106*a* and 106*b*, or 108*a* and 108*b*, and optionally a pair of straps 126*a*, 126*b*. Any part of the set 100, or matched parts such as cups or straps, may also be packaged and marketed separately.

Figure 2:
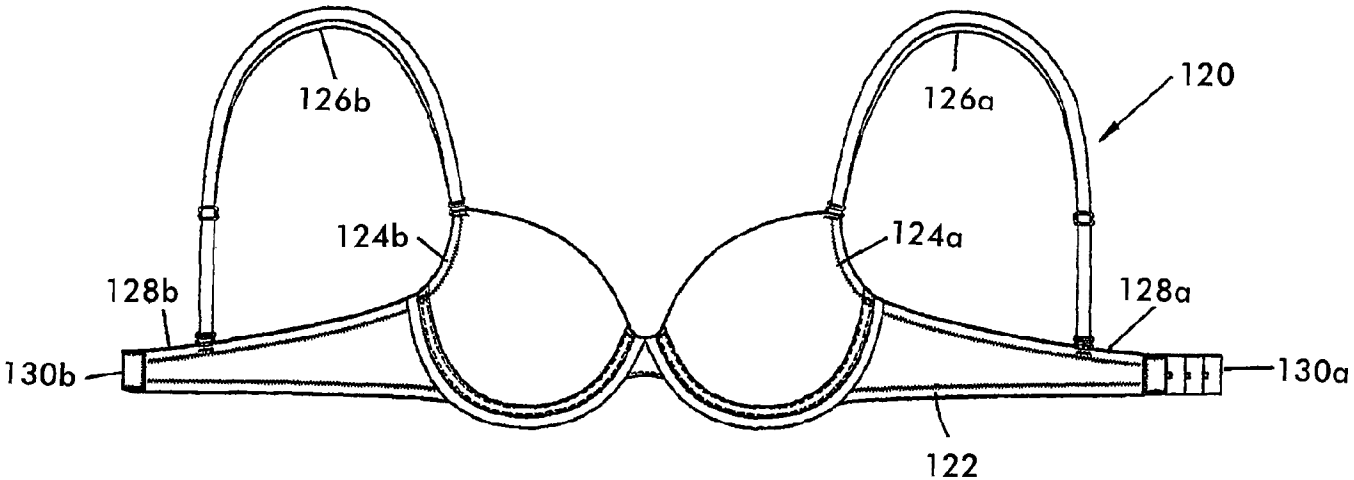
FIG. 2 illustrates a brassiere according to the first embodiment of the present disclosure.

Illustrated in FIG. 2 is a brassiere 120, according to the present disclosure. It includes a bra frame 122, to which a pair of detachable brassiere cups 124*a*, 124*b* are attached. Brassiere 120 also includes a pair of straps 126*a*, 126*b*, extending from the cups 124*a*, 124*b*, respectively, to a chest band wing panel 128*a*, 128*b*, respectively. Straps 126*a*, 126*b* are preferably selectively detachable from either or both the corresponding chest bands 128*a*, 128*b*, and/or cups 124*a*, 124*b*. Moreover straps 126*a*, 126*b*, if detachable, may be reconfigured in either crossover or halter fashion. Chest bands 128*a*, 128*b* may be secured to one another by corresponding hook 103*b* and eye 130*a* closure parts, or alternately hook-and-loop (e.g., VELCRO), button-and-eye, snaps, or the like.

Figure 3:
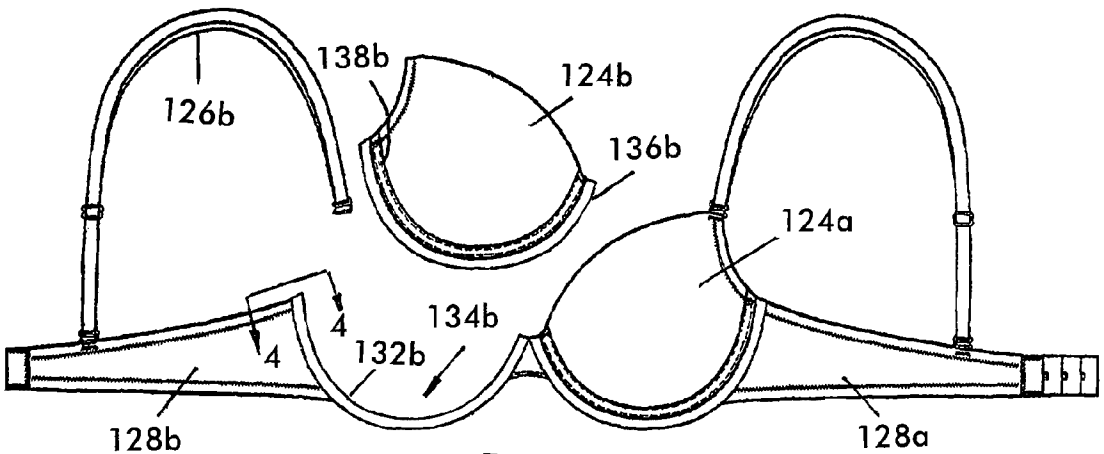
FIG. 3 illustrates the brassiere according to the first embodiment of the present disclosure in an alternate configuration having one brassiere cup removed
Figure 4:
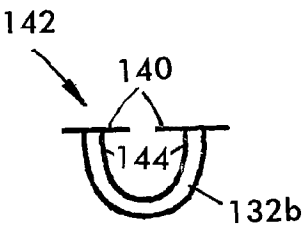
FIG. 4 is an end view taken along line 4-4 of FIG. 3.

Turning then to FIG. 3, illustrated is the brassiere 120 in an different configuration. Specifically, cup 124*b* is removed from frame 122, and strap 126*b* is detached from cup 124*b*. Also shown are the channel 132*b*, which is secured along and adjacent to an edge of the recess 134*b* of the bra frame 122, recess 134*b* being formed to receive the detachable cup 124*b*. Channel 132*b* slidably receives a latch 136*b*, latch 136*b* being secured along and adjacent to a lower edge of the cup 124*b*. Optionally, embedded within the cup 124*b* is a support underwire 138*b* (shown in hidden line). FIG. 4 illustrates a cross-sectional view of the channel 132*b* taken along line 4-4 of FIG. 3. In particular, the channel 132*b* includes a lip 140 extending partially across the channel opening 142 from either or both sides of the inner channel wall 144. The lip 140 aids in engaging and retaining the corresponding latch 138*b*. The description of the this one side of the brassiere 120 will be understood as sufficient to describe the opposing side, e.g. cup which is generally symmetrical across a vertical plane bisecting the brassiere 120.

Figure 5A:
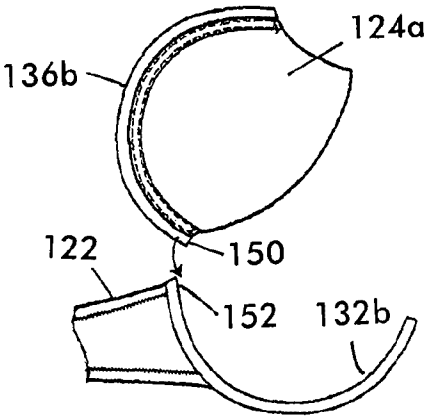
Figure 5B:
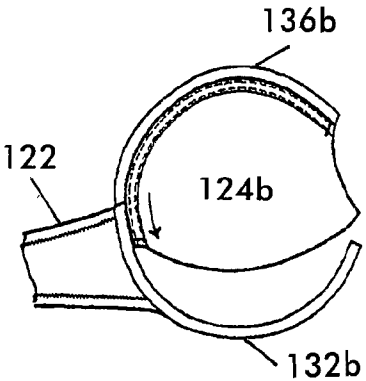
Figure 5C:
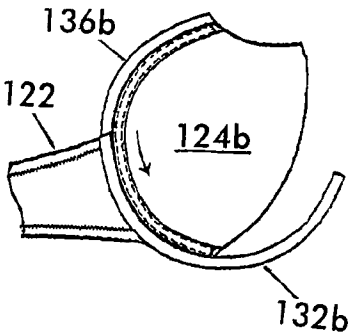
Figure 5D:
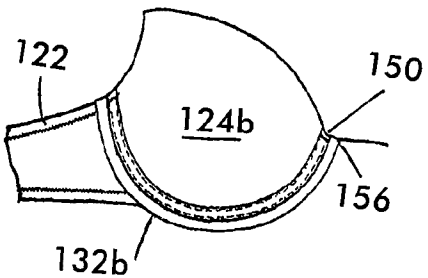

Turning now to FIGS. 5*a*, 5*b*, 5*c* and 5*d*, the method of engaging the cup 124*b* with the bra frame 122. As shown in FIG. 5*a*, a first end 150*b* of latch 136*b* is brought into engagement with an opposite end 152*b* of the corresponding channel 132*b*. With reference to FIGS. 5*b*, 5*c*, the latch 136*b* is slidably inserted into the channel 132*b* by generally rotating the cup 124*b*. With reference to FIG. 5*d*, the cup 124*b* is in position when the first end 150*b* is brought into alignment with a corresponding end 156 of the channel 132*b*.

Referring now to FIG. 6, illustrated is a rear side of cup 124*b*. Visible from the rear is a loop 160*b* by which the strap 126*b* is removably attached. Underwire 138*b* (shown in hidden line) is contained within a fabric casing 162*b*. Latch 138*b* may be secured to the cup 124*b* by stitching between the casing 162*b* and the cup fabric 166*b*. As shown in FIG. 6, pre-formed holes 164*b* may be provided in the latch 136*b* to facilitate the stitching. Alternately, the latch 136*b* may be secured by thermal or adhesive joining means, or any suitable joining technique as used in garment manufacture.

FIG. 7 illustrates a latch 136*b*. Latch 136*b* is generally arcuate in shape and has a span dimension 165, a depth dimension 167, and a circumferential dimension 169. In an exemplary embodiment, span dimension 165 is about 5.25 inches, depth dimension 167 is about 2.5 inches, and circumferential dimension 169 is about 7.5 inches. These specific dimensions are, of course, subject to change with various sizes of bra 120 and specifically cup 124*b*, or to change in general without departing from the scope of the present disclosure.

FIG. 8 illustrates a sample channel 132*b*. Channel 132*b* may also include pre-formed holes 168*b* to facilitate stitching, and/or be secured to the bra frame 122 by other suitable joining technique already mentioned with respect to the latch 136*b*. Both latch 136*b* and channel 132*b* (and their counterparts latch 136*a* and channel 132*a* of the opposing cup 124*a*) are preferably positioned to be concealed by the material of cup 124*b* and/or frame 122, for example inward with respect to the wearer's body and behind, when the latch 136*b* and channel 132*b* are engaged with one another, in order to provide a pleasing overall appearance. This is illustrated, for example, in FIG. 14.

In certain embodiments end 150*b* of the latch 136*b* and end 152*b* of channel 132*b* may given a surface treatment to visually distinguish them from the remainder of the structure. One such surface treatment may be color-coding, for example like-colored, in order to indicate their attachment to engage the cup 124*b* with the bra frame 122, and distinguished from the colored ends of the opposing cup 124*a*, which are themselves color-matched with one another. Alternately, the color may be simply to distinguish from the surrounding material of the bras 120 and its parts in order to facilitate visual alignment and engagement of the latch 136*b* and channel 132*b*. Further, a locking mechanism, such as a tab, hasp, or the like, may be provided to secure the latch 136*b* within the channel 132*b* when they are fully engaged with one another, i.e., end 150*b* positioned adjacent end 156*b* with latch 136*b* slidably engaged with channel 132*b*. A pressure on the locking a tab, hasp, or the like, or alternately on the channel 132*b* of latch in the vicinity of the a tab, hasp, or the like, would be sufficient to release the latch from the channel and permit the disengagement latch 136*b* from the channel 132*b*, and thus the cup 124*b* from the bra frame 122.

Turning to FIGS. 9*a* and 9*b*, illustrated generally is the engagement of the latch 136*b* and the channel 132*b* with one another, by illustrating both unattached and attached states, respectively.

Turning now to FIG. 10, illustrated in a front elevation view is the brassiere 120 according to a second embodiment of the present disclosure, having one cup 124*b* removed. The cup 124*b* is attached generally as described above with reference to FIGS. 4*a*-4*d*. Also visible in FIG. 9 is a rear loop 170*b*, where a strap 126*b* (not shown) may be removably attached to the chest band 128. A similar loop (obscured by cup 124*a*) may be provided on an opposing side of the chest band 128 from the detachable attachment of strap 126*a* thereto. Shown for the first time in FIG. 10 is an optional center front closure 172. With the provision of a center front closure 172, hook 103*b* and eye 130*a* closure parts (or their substitutes) may be optionally omitted, and a unitary chest band 128 formed in place of divided wing panels 128*a*, 128*b*.

In addition to FIGS. 9*a* and 9*b*, FIGS. 11*a*-11*b*, 12*a*-12*b*, and 13*a*-13*b* illustrate a variety of configurations for the latch and channel, in corresponding unattached and attached positions, respectively. In FIGS. 11*a*-11*b*, latch 236 and channel 232 are essentially identical, distinguished primarily by their placement, whether attached to brassiere cup 124*a*, 124*b*, or bra frame 122. Latch 236 (and channel 232) exhibit a flange 280 to facilitate connection with the corresponding cup 124*a*, 124*b* or bra frame 122. A generally u-shaped channel includes parallel walls 282, 284, each attached to a closed end 283. A lip 286 extends inward from the walls 282, 284, and preferably, as in this case, into the channel as well. The gap between the walls 282, 284, including any lip 286, in preferably no greater than the thickness of the wall 282, 284 of the counterpart latch or channel, including any lip 286. Thereby, the latch and the channel, once slidably engaged, resist transverse separation from each other. The material of the latch 236 and channel 232 is resilient, having some degree of flexibility, for example plastic or metal.

FIGS. 12*a*-12*b* illustrate latch 332 having a generally polygonal cross-section, in this case triangular, prismatically extended. Corresponding channel 336 includes side walls 384 angled inward towards a vertical centerline of the cross-section, preferably also including an inwardly extending lip 386. Other polygonal shapes aside from triangular may be substituted, for the latch 332, with corresponding adjustment to the shape of the channel 336. Latch 332 and channel 336 may be interchangeably located on either the cup portion or the bra frame portion.

FIGS. 13*a*-13*b* illustrate a further embodiment of the latch and channel. In this embodiment, latch 436 and channel 432 are essentially identical, distinguished essentially by their placement, whether cup 124*a*, 124*b* or bra frame 122. Latch 436 (and channel 432) also exhibit a flange 480 to facilitate connection with the corresponding cup 124*a*, 124*b* or bra frame 122. The flange extends into an inward spiral 488, optionally with a lip 486 of greater thickness. Channel 432 and latch 436 are again engaged with one another slidably, as generally described above, while resisting their transverse separation once slidably engaged. The embodiments of FIGS. 11*a*-11*b*, and 13*a*-13*b* have as advantages that they are essentially identical for both sides of the connection, reducing the manufacturing costs by reducing the number of parts that must be manufactured.

Turning now to FIGS. 15*a*-15*c*, 16*a*-16*c*, 17*a*-17*c*, 18*a*-18*c*, and 19*a*-19*c*, illustrated are a variety of support and fashion choices that can be present by various interchangeable cup designs with a single bra frame. For example, FIGS. 15*a*-15*c* shows an lightly padded cup style, cups 224*a*, 224*b*. FIG. 15*a* shows cups 224*a*, 224*b*. FIG. 15*b* shows cups 224*a*, 224*b*, the cups attached to the bra 120 in front elevation view. FIG. 15*c* shows the cups 224*a*, 224*b* attached to the bra 120 in rear elevation view. This view convention continues for FIGS. 16*a*-16*c*, 17*a*-17*c*, 18*a*-18*c*, and 19*a*-19*c*. FIGS. 16*a*-16*c* show sheer moulded cups 324*a*, 324*b*, including a scalloped edge finish 325*a*, 325*b*, respectively, at the upper edge of each cup 324*a*, 324*b*. FIGS. 17*a*-17*c* illustrate a so-called balconette cup 424*a*, 424*b*. Balconette cups 424*a*, 424*b* each including removable 'cookies', e.g., 426*a*, or pads which the wearer can choose to insert or remove from the cup, e.g., cup 424*a*, through opening e.g. 428*a*, as desired. The opposing cup 424*b* would be provided with similar cookie (not shown) and opening 428*b*. FIGS. 18*a*-18*c* illustrate padded push-up cups 524*a*, 524*b*, i.e., having more padding and consequently more lift than the lightly padded cups 224*a*, 224*b* of FIGS. 15*a*-15*c*. FIGS. 19*a*-19*c* illustrate demi cups 624*a*, 624*b*, e.g., one having a lower cut of neckline than other full cup styles.

Referring now to FIG. 20, an alternate embodiment of the present disclosure is illustrated. In this embodiment, brassiere 720 includes a cup assembly 721, including a pair of brassiere cups 724*a*, 724*b*, connected with one another by a bridge 725, alternately or additionally having a releasable front center closure 770. On an inside (with respect to the wearer) of an lateral outer edge of each cup 724*a*, 724*b*, a plurality of closures 736*a*, 736*b* connect the cup assembly 721 with a seamless tubular back 728. Straps 726*a*, 726*b*, selectively detachable from either or both cup assembly 721 and seamless tubular back 728, may also connect the cup assembly 721 generally at a top of each cup 724*a*, 724*b*, with the tubular back 728. Alternately, back portion 728 may also include a conventional closure (not shown), for example hook-and-eye or alternative described elsewhere herein.

Turning then to FIG. 21, the cup assembly 721, with straps 726*a*, 726*b* still attached thereto, is shown detached from the back portion 728 of the brassiere 720. The back portion 728 may include a loops 770*a*, 770*b* for receiving the releasable straps 726*a*, 726*b*, as described with respect to earlier embodiments. Closures 736*a*, 736*b* are illustrated as snaps connecting the cup assembly 721 to the back portion 728 with corresponding structure 732*a*, 732*b*, which can be substituted for hook-and-eye closures, other closure styles noted elsewhere, or a zipper.

Turning then to FIG. 22, note that the snaps 736*b* connecting the cup assembly 721 with the back portion 728 may be integrated along an underwire channel 762*b*. Four snaps are illustrated, though more or fewer may be suitable or desired. FIG. 22 also shows a loop 760 at the cup 724*b* for receiving the releasable strap 726*b*. Alternately, a snap, hook-and-eye, or other releasable closure (e.g., hook-and-loop, known by the trade name VELCRO) may be substituted in this or other embodiments.

Referring now to FIGS. 23 and 24, the manner of attaching the back portion 728 to the cup assembly 721 is shown. Notwithstanding the curvature of the cup 724*a*, 724*b*, the underwire, or the curved nature of the snaps, hooks, etc., located thereon, the back portion 728 may simply rectangular. Elasticity of the back portion 728 can account for the difference in shapes at the joining. Alternately, the cup assembly 721 and the back portion 728 may be tailored to fit with one another. The snaps on the back portion 728 may be located on an outward surface thereof, with respect to the wearer, to meet the inner surface of the cup assembly 721 having the corresponding closure structure 736*a*, 736*b*. Thereby, the snaps are prevented from causing any discomfort to the wearer.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. An intimate apparel apparatus comprising:

a brassiere frame having a chest band for securing the brassiere frame to the wearer, and a first arcuate recess in the brassiere frame for receiving a first detachable brassiere cup, a first arcuate channel located along an edge of the first arcuate recess;

the first detachable brassiere cup having a first arcuate latch at a perimeter thereof;

wherein the first arcuate latch and the first arcuate channel being slidably engageable with one another, the first arcuate latch and the first arcuate channel having substantially identical cross sections, and the substantially identical cross sections of the first arcuate latch and the first arcuate channel being configured and operative to resist transverse separation of the first arcuate latch and the first arcuate channel from each other when slidably engaged;

wherein the cross section of the first arcuate latch and the first arcuate channel includes a spiral portion; and wherein the cross section of the first arcuate latch and the first arcuate channel includes a lip section of relatively greater thickness at an end thereof.

2. The intimate apparel apparatus according to claim 1, wherein the cross section of the first arcuate latch and the first arcuate channel includes a pair of substantially parallel walls.

3. An intimate apparel apparatus comprising:

a brassiere frame having a chest band for securing the brassiere frame to the wearer, and a first arcuate recess in the brassiere frame for receiving a first detachable brassiere cup a first arcuate channel located along an edge of the first arcuate recess;

the first detachable brassiere cup having a first arcuate latch at a perimeter thereof;

wherein the first arcuate latch and the first arcuate channel being slidably engageable with one another, the first arcuate latch and the first arcuate channel having substantially identical cross sections, and the substantially identical cross sections of the first arcuate latch and the first arcuate channel being configured and operative to resist transverse separation of the first arcuate latch and the first arcuate channel from each other when slidably engaged;

wherein the cross section of the first arcuate latch and the first arcuate channel includes a pair of substantially parallel walls; and wherein the cross section of the first arcuate latch and the first arcuate channel includes a lip section of relatively greater thickness at an end of at least one of the substantially parallel walls.

4. The intimate apparel apparatus according to claim 3, wherein the cross section of the first arcuate latch and the first arcuate channel includes a closed end to which the substantially parallel walls are each attached, and the lip section extends into an area bounded by the closed end and the substantially parallel walls.

5. The intimate apparel apparatus according to claim 2, wherein the cross section of the first arcuate latch and the first arcuate channel includes a closed end to which the substantially parallel walls are each attached.

6. The intimate apparel apparatus according to claim 2, wherein the distance between the nearest points of the substantially parallel walls is no greater than about the largest thickness of either of the substantially parallel walls.

7. The intimate apparel apparatus according to claim 1, wherein the first arcuate latch includes a latch flange by which the first arcuate latch is secured to the first detachable brassiere cup, and the first arcuate channel includes a channel flange by which the first arcuate channel is secured to the brassiere frame.

8. The intimate apparel apparatus according to claim 1, wherein the first arcuate latch and the first arcuate channel are concealed in a front view by material of the brassiere frame or the first detachable brassiere cup.

9. An intimate apparel apparatus comprising:

a brassiere frame having a chest band for securing the brassiere frame to the wearer, and a first arcuate recess in the brassiere frame for receiving a first detachable brassiere cup a first arcuate channel located along an edge of the first arcuate recess;

the first detachable brassiere cup having a first arcuate latch at a perimeter thereof;

wherein the first arcuate latch and the first arcuate channel being slidably engageable with one another, the first arcuate latch and the first arcuate channel having substantially identical cross sections, and the substantially identical cross sections of the first arcuate latch and the first arcuate channel being configured and operative to resist transverse separation of the first arcuate latch and the first arcuate channel from each other when slidably engaged; and wherein the first arcuate latch and the first arcuate channel are slidably engageable at a first end of the first arcuate latch and an opposing second end of the first arcuate channel, and at least one of the first end of the first arcuate latch and the second end of the first arcuate channel are provided with a surface treatment to enhance their visibility.

10. The intimate apparel apparatus according to claim 9, wherein the surface treatment is a color which contrasts with the material of at least one of the brassiere frame, the first detachable cup, and some part of the first arcuate latch or the first arcuate channel distal from the treated end.

11. The intimate apparel apparatus according to claim 10, wherein a similar color is applied to both of the first end of the first arcuate latch and the second end of the first arcuate channel.

12. The intimate apparel apparatus according to claim 1, further comprising:

the brassiere frame having a second arcuate recess for receiving a second brassiere cup, a second channel located along an edge of the second arcuate recess; and a second detachable brassiere cup having a second arcuate latch at a perimeter thereof.

13. The intimate apparel apparatus according to claim 12, wherein the first arcuate latch and the first arcuate channel are slidably engageable at a first end of the first arcuate latch and an opposing second end of the first arcuate channel;

the second arcuate latch and the second channel are slidably engageable at a third end of the second arcuate latch and an opposing fourth end of the second arcuate channel;

the first end of the first arcuate latch and the second end of the first arcuate channel are provided with a first color which contrasts with the material of at least one of the brassiere frame, the first detachable cup, and some part of the first arcuate latch or the first arcuate channel distal from the colored end; and the third end of the second arcuate latch and the fourth end of the second arcuate channel are provided with a second color which contrasts with the material of at least one of the brassiere frame, the second detachable cup, and some part of the second arcuate latch or the second arcuate channel distal from the colored end.

14. An intimate apparel set comprising:

a brassiere frame having a chest band for securing the brassiere frame to the wearer, first and second arcuate recess in the brassiere frame for receiving first and second detachable brassiere cups, respective first and second channels located along an edge of the first and second arcuate recess;

a plurality of detachable brassiere cup pairs, a first detachable brassiere cup of each pair having a first arcuate latch at a perimeter thereof, and second detachable brassiere cup of each pair having a second arcuate latch at a perimeter thereof, wherein the first arcuate latch of each first detachable brassiere cup and the first arcuate channel being slidably engageable with one another, the second arcuate latch of each second detachable brassiere cup and the second channel being slidably engageable with one another;

the first and second arcuate latches and the first and second channels each having substantially identical cross sections, and the substantially identical cross sections of the first and second arcuate latches and the first and second channels being configured and operative to resist transverse separation of the first arcuate latch and the first arcuate channel from each other when slidably engaged;

wherein the cross section of the first arcuate latch and the first arcuate channel includes a spiral portion; and wherein the cross section of the first arcuate latch and the first arcuate channel includes a lip section of relatively greater thickness at an end thereof.

15. The intimate apparel set according to claim 14, further comprising:

a first pair of brassiere straps, selectively detachable from at least one of the brassiere frame and at least one of the plurality of detachable brassiere cup pairs.

16. The intimate apparel set according to claim 14, wherein the plurality of detachable brassiere cup pairs each comprise a distinguished style, size, shape, color material, or pattern from the other detachable brassiere cup pairs.

17. The intimate apparel apparatus according to claim 3, further comprising:

the brassiere frame having a second arcuate recess for receiving a second brassiere cup, a second channel located along an edge of the second arcuate recess; and a second detachable brassiere cup having a second arcuate latch at a perimeter thereof.

18. The intimate apparel apparatus according to claim 9, further comprising:

the brassiere frame having a second arcuate recess for receiving a second brassiere cup, a second channel located along an edge of the second arcuate recess; and a second detachable brassiere cup having a second arcuate latch at a perimeter thereof.

19. The intimate apparel apparatus according to claim 3, wherein the first arcuate latch and the first arcuate channel are concealed in a front view by material of the brassiere frame or the first detachable brassiere cup.

20. The intimate apparel apparatus according to claim 9, wherein the first arcuate latch and the first arcuate channel are concealed in a front view by material of the brassiere frame or the first detachable brassiere cup.

* * * * *